United States Patent [19]

McMillen

[11] Patent Number: 4,519,454

[45] Date of Patent: May 28, 1985

[54] COMBINED THERMAL AND SOLVENT STIMULATION

[75] Inventor: James M. McMillen, Arlington, Tex.

[73] Assignee: Mobil Oil Corporation, New York, N.Y.

[21] Appl. No.: 564,045

[22] Filed: Dec. 21, 1983

Related U.S. Application Data

[63] Continuation-in-part of Ser. No. 307,543, Oct. 1, 1981, abandoned.

[51] Int. Cl.[3] ..... E21B 43/24

[52] U.S. Cl. ..... 166/303; 166/267

[58] Field of Search ..... 166/267, 303, 305 R

[56] References Cited

U.S. PATENT DOCUMENTS

| | | | |
|---|---|---|---|
| 3,530,939 | 9/1970 | Turner et al. | 166/303 |
| 3,881,550 | 5/1975 | Barry | 166/272 |
| 4,034,812 | 7/1977 | Widmyer | 166/303 |
| 4,250,964 | 2/1981 | Jewell et al. | 166/303 |
| 4,268,403 | 5/1981 | Buckman et al. | 166/305 R X |
| 4,280,559 | 7/1981 | Best | 166/303 |
| 4,293,035 | 10/1981 | Fitch | 166/273 |

OTHER PUBLICATIONS

Heller, "Onset of Instability Patterns Between Miscible Fluids In Porous Media", *Journal of Applied Physics*, vol. 37, No. 4, 1566–1579, Mar. 15, 1966.

*Primary Examiner*—George A. Suchfield
*Attorney, Agent, or Firm*—Alexander J. McKillop; Michael G. Gilman; Stanislaus Aksman

[57] ABSTRACT

This invention provides a method for recovering heavy crude oil from an underground reservoir penetrated by a well, which comprises (a) heating the reservoir surrounding the wellbore with steam at a temperature below coking temperature but sufficient to increase the temperature 40°–200° F. above the reservoir temperature; (b) producing the formation until most of the injected water is produced; (c) injecting a liquid solvent having a ratio of crude viscosity to solvent viscosity of at least about 10 and in an amount ranging from about 5 to about 25 barrels per foot of oil-bearing formation; (d) producing a solvent-crude mixture; and (e) repeating steps (c) and (d).

10 Claims, No Drawings

COMBINED THERMAL AND SOLVENT STIMULATION

BACKGROUND OF THE INVENTION

Cross-Reference to Related Application

This application is a continuation-in-part of copending application Ser. No. 307,543, filed Oct. 1, 1981, now abandoned the contents of which are hereby expressly incorporated herein by reference.

1. Field of the Invention

This invention is concerned with the stimulation of production of heavy crude oil from a porous reservoir.

2. Description of the Prior Art

Both solvent concentration and temperature have an effect on the viscosity of crude oil and mixtures of crude oil and solvent. As each is increased, the viscosity is decreased, allowing improved flow in a formation.

The use of steam alone for increasing temperature and decreasing viscosity results in large quantities of water added to a reservoir. Further, the high temperatures result in coking near the wellbore, plugging flow paths. Steam stimulation must be repeated, compounding these problems.

The technique of this invention will give better reduction of viscosity than heat or solvent alone, without much of the expense or problems when using heat alone.

SUMMARY OF THE INVENTION

A method for recovering heavy crude oil from an underground reservoir penetrated by a well, which comprises (a) heating the reservoir surrounding the wellbore with steam at a temperature below coking temperature but sufficient to increase the temperature 40°–200° F. above the reservoir temperature; (b) producing the formation until some of the water injected as steam is produced; (c) injecting a liquid solvent having a ratio of crude viscosity to solvent viscosity of at least about 10 and in an amount ranging from about 5 to about 25 barrels per foot of oil-bearing formation; and (d) producing a solvent-crude mixture.

DESCRIPTION OF SPECIFIC EMBODIMENTS

As used in the specification and claims, "heavy" crude oil is viscous crude oil that has poor flow characteristics in the reservoir. In general, it is a crude oil that has an API gravity of about 20 degrees or lower.

In the first step of the method of this invention, there is injected into the reservoir steam low enough in temperature to prevent coking, but high enough to increase the temperature to a selected temperature 40°–200° F. above the reservoir temperature. In general, the steam is injected at a temperature of between about 300° F. and about 600° F. The amount of steam injected is sufficient to heat the reservoir surrounding the wellbore.

After the steam has been injected, the well is placed on production and production is continued until some of the water injected as steam has been recovered, sufficient to clear out the excess water from the reservoir near the wellbore.

After production is stopped, a solvent is injected into the reservoir. The solvent should be substantially, but not necessarily completely, miscible with the heavy crude oil. It must have a viscosity lower than that of the heavy crude oil. In general, the ratio of crude viscosity to solvent viscosity at reservoir conditions should be at least about 10, preferably 100 or more. Suitable solvents include light crude oil, syncrude, diesel fuel, condensate, cutter stock, or other light hydrocarbons. The injected solvent having the desired viscosity moves away from the wellbore into the formation forming solvent fingers that are larger near the wellbore and decrease in size as they advance into the formation. The solvent fingers near the wellbore provide a high mobility path for subsequent produced oil backflowing into the well. To provide adequate solvent fingering near the wellbore and significantly reduce the viscosity of the in-place oil by diffusion and mixing, the amount of solvent injected is between about 5 barrels and about 25 barrels per foot of oil-bearing formation, preferably between about 10 barrels and about 20 barrels.

After solvent injection has been completed, there should be little or no soak time, i.e., the time between the end of solvent injection and the start of production. Generally, the soak time will be between about an hour or less and about 48 hours, preferably less than 24 hours. In accordance with this invention, there is little advantage, if any, in an appreciable soak time to effect diffusive mixing of solvent and heavy oil. It appears that a prolonged soak time of several days or more isolates solvent by gravity driven mixing and destroys the high mobility paths near the well, so that there is little increase in production over that obtained in unstimulated production. Then, production is resumed and continued until the amount of solvent in the produced oil has dropped to about 12 percent or lower.

Thereafter, the solvent injection/production cycles, as described hereinbefore, are repeated. The first production following a solvent injection is solvent-rich and can be retained and used for injection in the same well or another well. When the produced oil temperature drops to 20° F. above untreated produced oil temperature, the steaming portion of the process is repeated to reheat the reservoir. Optionally, the solvent injected can be heated to the desired temperature.

The produced mixture of solvent and heavy crude oil can be used as a refinery charge stock. Alternatively, the solvent can be separated from the produced oil on site, if desirable or practical, by some separation method, such as a topping plant, and used for subsequent injections.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A combined thermal-and-solvent stimulation method for recovering heavy crude oil from an underground reservoir penetrated by a well, which comprises:

(a) heating the reservoir surrounding the well with steam at a temperature below coking temperature but sufficient to increase the temperature 40°–200° F. above the reservoir temperature;

(b) producing the formation substantially immediately after the reservoir is heated, and without a soak period separating step (a) from step (b) until some of the water injected as steam is produced;

(c) injecting a liquid solvent having a ratio of crude viscosity to solvent viscosity of at least about 10 and in an amount ranging from about 5 to about 25 barrels per foot of oil-bearing formation to provide adequate solvent fingering near the wellbore and significantly reduce the viscosity of the heavy crude oil; and (d) producing a solvent-crude mixutre.

2. The method of claim 1, wherein said steam in step (a) is at a temperature between about 300° F. and about 600° F.

3. The method of claim 2, wherein said viscosity ratio during step (c) is at least about 100.

4. The method of claim 3, wherein the amount of solvent injected in step (c) is between about 10 and about 20 barrels per foot of oil-bearing formation.

5. The method of claim 4, wherein the solvent injected in step (c) is a light crude oil, syncrude, diesel fuel, condensate or cutter stock.

6. The method of claim 5 further including the step of allowing the reservoir to undergo a brief soak period ranging from about one hour to about 48 hours after solvent injection according to step (c).

7. The method of claim 6, wherein the soak time is between about one hour and about 24 hours.

8. The method of claim 7, wherein producing in step (d) is continued until the amount of solvent in the solvent-crude mixture drops below about 12 percent.

9. The method of claim 8, wherein steps (c) and (d) are repeated.

10. The method of claim 9 wherein the solvent injected in step (c) is a light crude oil.

* * * * *